US011592144B2

(12) United States Patent
Chakkalakal et al.

(10) Patent No.: US 11,592,144 B2
(45) Date of Patent: Feb. 28, 2023

(54) AUTOMATED RE-MELT CONTROL SYSTEMS

(71) Applicant: nVent Services GmbH, Schaffhausen (CH)

(72) Inventors: Franco A. Chakkalakal, Manvel, TX (US); Mike Allenspach, Sugar Land, TX (US); Kent Kalar, Austin, TX (US)

(73) Assignee: nVent Services GmbH, Schaffhausen (CH)

( * ) Notice: Subject to any disclaimer, the term of this patent is extended or adjusted under 35 U.S.C. 154(b) by 96 days.

(21) Appl. No.: 16/854,524

(22) Filed: Apr. 21, 2020

(65) Prior Publication Data

US 2020/0248875 A1 Aug. 6, 2020

Related U.S. Application Data

(63) Continuation of application No. 15/701,383, filed on Sep. 11, 2017, now Pat. No. 10,634,284.
(Continued)

(51) Int. Cl.
*F17D 3/01* (2006.01)
*F17D 5/00* (2006.01)
*F17D 1/08* (2006.01)

(52) U.S. Cl.
CPC ..... *F17D 3/01* (2013.01); *F17D 1/084* (2013.01); *F17D 5/005* (2013.01)

(58) Field of Classification Search
None
See application file for complete search history.

(56) References Cited

U.S. PATENT DOCUMENTS 3,339,985 A 9/1967 Every et al.
3,967,860 A 7/1976 Fonseca et al.
(Continued)

FOREIGN PATENT DOCUMENTS

CN 102661486 A 9/2012
CN 204675833 U 9/2015
(Continued)

OTHER PUBLICATIONS

Inaudi et al., "Long-Range Pipeline Monitoring by Distributed Fiber Optic Sensing", ASME 2010. (Year: 2010).*
(Continued)

*Primary Examiner* — Carlos R Ortiz Rodriguez
(74) *Attorney, Agent, or Firm* — Quarles & Brady LLP

(57) ABSTRACT

A system may automatically control a pipeline heating system to maintain a desired temperature and/or to provide flow assurance of process fluid along a pipeline. The system may identify the occurrence and location of the solidification of a given process fluid or the melting of the given process fluid by monitoring temperatures along the pipeline and identifying from the monitored temperatures the occurrence and location of a latent heat signature associated with the solidification or melting of the given process fluid. The system may calculate and display fill percentages of the solidified process fluid at locations along the pipeline. The system may determine the percentage of a given section of pipeline that is filled with solid and/or liquid process fluid on a meter-by-meter basis. The system may perform automated re-melt operations to resolve plugs of solidified process fluid that may occur in the pipeline.

20 Claims, 6 Drawing Sheets

Related U.S. Application Data

(60) Provisional application No. 62/433,706, filed on Dec. 13, 2016, provisional application No. 62/385,718, filed on Sep. 9, 2016.

(56) References Cited

U.S. PATENT DOCUMENTS

| | | | |
|---|---|---|---|
| 4,137,938 | A | 2/1979 | Logan |
| 4,835,687 | A | 5/1989 | Martin |
| 5,774,372 | A | 6/1998 | Berwanger |
| 6,026,839 | A | 2/2000 | Kriebel et al. |
| 6,871,118 | B2 | 3/2005 | Henriot et al. |
| 7,647,136 | B2 | 1/2010 | McDowell |
| 2004/0059505 | A1 | 3/2004 | Gallagher |
| 2005/0283276 | A1 | 12/2005 | Prescott et al. |
| 2010/0175689 | A1 | 7/2010 | Zillmer et al. |
| 2012/0165995 | A1 | 6/2012 | Crawley et al. |
| 2013/0000732 | A1 | 1/2013 | Flashaar et al. |
| 2013/0068340 | A1 | 3/2013 | Chakkalakal |
| 2014/0326329 | A1 | 11/2014 | Zikeli et al. |
| 2015/0177042 | A1 | 6/2015 | Song et al. |
| 2016/0018040 | A1 | 1/2016 | Kristiansen |
| 2016/0245447 | A1 | 8/2016 | Crombie et al. |

FOREIGN PATENT DOCUMENTS

| | | | |
|---|---|---|---|
| DE | 102008056089 | A1 | 7/2010 |
| EP | 0485220 | A1 | 5/1992 |
| GB | 2491236 | A | 11/2012 |
| JP | H03194500 | A | 8/1991 |
| WO | 2010052126 | A1 | 5/2010 |
| WO | 2014169146 | A1 | 10/2014 |
| WO | 2015023462 | A1 | 2/2015 |

OTHER PUBLICATIONS

Beres, Chakkalakal, McMechen, Sandberg P.E., Controlling Skin Effect Heat Traced Liquid Sulfur Pipelines with Fiber Optics; Copyright Material IEEE, Paper No. PCIC-2004-36; 8 pages.

* cited by examiner

300

FAQ 1-SEARCH 2-SEET DIAGNOSTICS 3-VOID SPACES 4-HOT SPOT TRENDING 4-COLD SPOT TRENDING | 5-PIPELINE REPORTS | 6-PLOTS

BREADCRUMBS
- PIPELINE 1003 SEET HEATING LOSS AT SS15 PA
- PIPELINE 1004 RTD ERROR AT SS12 PB
- PIPELINE 1005 VOID SPACE INCREASING AT 15,202 m

METRICS BAR

| 174 $m^3$/hr | 148 °c | 131°c | 842 m | 12 °c |
|---|---|---|---|---|
| FLOW RATE | HIGH TEMP | LOW TEMP | MAX VOID SIZE | SEET DELTA |

ALERTS
SEET SUBSTATION 6 NEEDS IMMEDIATE ATTENTION!

PIPELINE TAG CLOUD
PIPELINE 1006

HEAT LOSS WINDOW
23 HRS 30 MIN

SEARCH
OPEN MY RECENT SEARCHES

BOOKMARKS
PIPELINE 1006
- SYSTEM OVERVIEW
- SEET DATA

PIPELINE 1005
- SYSTEM OVERVIEW

PIPELINE 1004
- SYSTEM OVERVIEW
- FLOW HISTORY

PIPELINE 1003
- SYSTEM OVERVIEW
- PIPE FILL DATA

PIPELINE INFORMATION

MESSAGE LOG | PIPE FILL DATA | FREEZE TIMES | FLOW HISTORY | SEET DATA

| MESSAGE | DATE | ACKNOWLEDGEMENT | STATUS |
|---|---|---|---|
| LOWER SET-POINT ON SUBSTATION 6 SEET SYSTEM BY 5°C TO 130°C | 23 MAR 2014 | OPEN | ATTENTION REQUIRED |
| SUBSTATION 3 SEET SYSTEM HAS STOPPED HEATING-SUSPECTED POWER LOSS | 13 MAR 2014 | 1 HOUR, 15 MINUTES | CORRECTED |
| SUBSTATION 4 SEET RTD VALUE OUT OF CALIBRATION-RECALIBRATE OR REPLACE | 3 MAR 2014 | OPEN | ATTENTION REQUIRED |
| AIR POCKET GROWING AT 12,798 METERS FLUID LEVEL=LOW, SIZE=953 METERS | 26 FEB 2014 | 8 MINUTES | ATTENTION REQUIRED |
| FLOW RATE BELOW SEET DESIGN SPECIFICATIONS | 18 FEB 2014 | 5 HOURS, 4 MINUTES | CORRECTED |
| SUBSTATION 8 SEET CIRCUIT IMBALANCE TEMPERATURE DELTA=19°C | 18 FEB 2014 | 7 HOURS, 52 MINUTES | CORRECTED |

FIG. 3

AUTOMATED RE-MELT CONTROL SYSTEMS

CROSS-REFERENCE TO RELATED APPLICATIONS

This application is a continuation of, claims priority to, and incorporates herein by reference in its entirety, U.S. Non-Provisional patent application Ser. No. 15/701,383, filed Sep. 11, 2017, which claims priority to U.S. Provisional Application Ser. No. 62/385,718, filed Sep. 9, 2016, and U.S. Provisional Application Ser. No. 62/433,706, filed Dec. 13, 2016.

BACKGROUND OF THE INVENTION

The present invention relates to pipeline monitoring and management systems, and particularly to systems for automatically controlling a pipeline heating system to maintain a desired temperature and/or to provide flow assurance of process fluid along the pipeline.

Managing the temperature of a process fluid (e.g., oil, natural gas, molten materials) during transportation through a pipeline can be of key concern, particularly when the process fluid is a material that exhibits changing viscosity characteristics relative to temperature. For example, the most critical issue in the performance and operational life of a Sulphur pipeline is the safe and reliable re-melt of solidified Sulphur to re-establish flow. Most attention has historically been placed on assuring that the required pipeline maintenance temperature is achieved during normal operations. The management of liquid Sulphur pipelines has been left largely to the shift operator who uses his judgement and experience to make appropriate decisions. This is a highly manual and operator-dependent approach, with limited or no real-time data used to drive decisions. It becomes, many times, a "best guess" manual approach to managing the pipeline. Manually driven re-melt programs can fail due to human error, and the chances of failing to utilize safe, reliable and repeatable re-melting methods of solidified process fluid in the pipeline could result in a plant shutdown due to a pipeline rupture or damage from excessive movement of solidified process fluid and/or pipe anchor failures.

It may therefore be desirable to provide improved pipeline re-melt systems and processes.

SUMMARY OF THE INVENTION

The foregoing needs are met by the methods, apparatus, and/or systems for automatically monitoring and managing the uniform thermal profile of a pipeline in order to maintain desired characteristics, particularly temperature, of the process fluid in the pipeline. In some embodiments, a monitoring and management system for a pipeline may include: one or more trace heating cables, such as skin-effect heat tubes, to provide heat to the pipeline (e.g., as part of a heating system); a fiber optic cable for distributed temperature sensing along the pipeline; a plurality of sensors for detecting and reporting pipeline operating data; pre-insulated pipe; isolated pipe supports and anchors; and a re-melt program implemented on computerized monitoring devices. The combined instrumentation along the pipeline may be used to gather key decision-making data; the present processes operate on such data to determine whether to change operating parameters of the heating system and/or generate alarms in response to changes in the thermal profile.

With respect to Sulphur pipeline maintenance in particular, the present systems and methods combine recent developments in predictive modelling, transient analysis and improved software solutions, to create a dynamic, real-time model for the solidified Sulphur as it transforms through its phase change to liquid state inside the pipeline. As the potential exists for re-melting to occur at different rates in various portions of the line, it is imperative to perform this activity in a manner that does not allow for overpressure or other pipeline failure modes to occur. In addition, automated remelt decisions may be improved by lessening or eliminating their dependence on the melting and freezing points of the Sulphur, which can vary due to material purity, pipeline pressure, and other factors. This disclosure addresses, among other things, the requirement to collect data, and the necessary procedure to collect such data, during initial testing, pre-commissioning, commissioning, and/or preliminary re-melt testing activities before the pipeline is put into service. In some embodiments, the present disclosure provides a data driven, automated re-melt/re-heat methodology for a liquid Sulphur pipeline that combines data generated from various integrated technologies, and using customized algorithms. The result is a sophisticated proprietary software framework with asset mapping, parameter benchmarking, dense data collection and specialized data manipulation techniques, all delivered through a dedicated "dashboard" on a pipeline management display console.

These and other aspects of the invention will become apparent from the following description. In the description, reference is made to the accompanying drawings which form a part hereof, and in which there is shown embodiments of the invention. Such embodiments do not necessarily represent the full scope of the invention and reference is made therefore, to the claims herein for interpreting the scope of the invention.

BRIEF DESCRIPTION OF THE DRAWINGS

The present disclosure will hereafter be described with reference to the accompanying drawings, wherein like reference numerals denote like elements.

FIG. 3 is a diagram of a pipeline management console screen in accordance with an embodiment.

DETAILED DESCRIPTION

Figure 1:
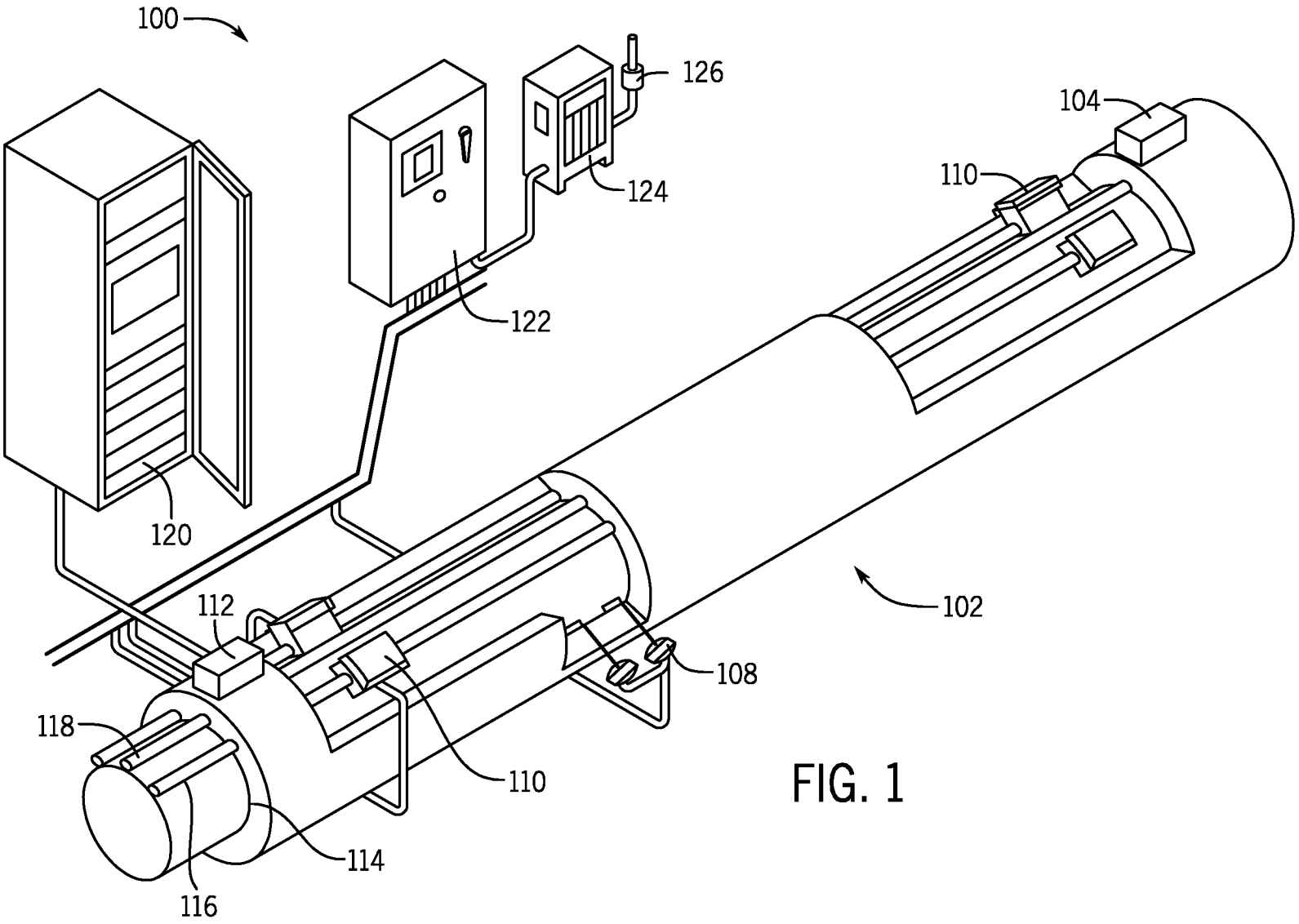
FIG. 1 is a schematic diagram of a skin-effect trace heating system with fiber optic distributed temperature sensing (DTS) in accordance with an embodiment.

Before the present invention is described in further detail, it is to be understood that the invention is not limited to the particular aspects described. It is also to be understood that the terminology used herein is for the purpose of describing particular aspects only, and is not intended to be limiting.

The scope of the present invention will be limited only by the claims. As used herein, the singular forms "a", "an", and "the" include plural aspects unless the context clearly dictates otherwise.

It should be apparent to those skilled in the art that many additional modifications beside those already described are possible without departing from the inventive concepts. In interpreting this disclosure, all terms should be interpreted in the broadest possible manner consistent with the context. Variations of the term "comprising", "including", or "having" should be interpreted as referring to elements, components, or steps in a non-exclusive manner, so the referenced elements, components, or steps may be combined with other elements, components, or steps that are not expressly referenced. Aspects referenced as "comprising", "including", or "having" certain elements are also contemplated as "consisting essentially of" and "consisting of" those elements, unless the context clearly dictates otherwise. It should be appreciated that aspects of the disclosure that are described with respect to a system are applicable to the methods, and vice versa, unless the context explicitly dictates otherwise.

Numeric ranges disclosed herein are inclusive of their endpoints. For example, a numeric range of between 1 and 10 includes the values 1 and 10. When a series of numeric ranges are disclosed for a given value, the present disclosure expressly contemplates ranges including all combinations of the upper and lower bounds of those ranges. For example, a numeric range of between 1 and 10 or between 2 and 9 is intended to include the numeric ranges of between 1 and 9 and between 2 and 10.

The present disclosure is presented with particular details relevant to the monitoring of liquid Sulphur and re-melting of solidified Sulphur in a Sulphur pipeline, but these details may also apply to other pipelines and other process fluids, including petroleum, various types of crude or processed oil, natural and highly volatile gasses, chemicals, and the like. The descriptions herein therefore are not limited in application to Sulphur pipelines.

Pipeline failures may be caused by: pressure build-up in pipeline due to lack of pressure management; welded pipe shoes or faulty anchor design, with high heat loss; insufficient thickness and/or poor field installation of thermal insulation; inability to monitor pipeline temperature along the entire length of the pipeline; absence of any extra heat delivery capability during "emergency conditions" when localized heat losses create cold zones along the pipeline; excessive pipeline movements; "runaway heating" at voids/empty zones, present in the pipeline from process fluid (e.g., Sulphur) solidification; and, absence of a clear and methodical re-melt procedure. The dynamics of these issues require a multi-disciplinary approach and in-depth experience with process fluid (e.g., Sulphur) properties and pipeline operational behavior in order for these issues to be properly addressed. In traditional heating systems, poor planning may result in a non-homogenous thermal profile for the pipeline, and solidification of process fluid occurring at unknown locations.

A 100% uniform thermal profile (i.e., with respect to the temperature of the process fluid) along the entire constructed pipeline is ideal, but is oftentimes not realistic. Localized thermal discontinuities (from a heat transfer perspective) can create a complex and dynamic environment. These discontinuities could include pipeline void spaces (liquid-free zones), excessive heat loss zones (such as pipe supports/anchors) and the impact of elevational changes (peaks/valleys and/or vertical risers). To combat these discontinuities, a dense mesh, accurate mapping of the rate of temperature change, along with other operational parameters, may yield a more sophisticated and predictable real-time model for process fluid re-melt. The development of specialized algorithms based on trends in measured data during commissioning and preliminary start-up could provide the early indication of potential failure modes and can serve to more precisely monitor and assess dynamic pipeline conditions, attributing to the successful implementation of a customized automated re-melt program.

When planning a new pipeline, there are key aspects to consider early in the project cycle which will ultimately determine the operational benefits of the completed asset. Here, the example of a Sulphur pipeline is considered. The physical properties of Sulphur and its narrow operating temperature zone create many design challenges. Since Sulphur will begin to freeze at temperatures around 119° C., most pipelines are operated at a temperature between 135° C. and 150° C. It is important to design and implement a pipeline geometry that accommodates the large pipe movements during start-up and through temperature cycles during the pipeline's lifetime. In particular, for a pipeline design the symbiotic relationship between three categories of characteristics should be understood and carefully considered: the physical characteristics of the Sulphur material itself; the mechanical configuration of the pipeline, including supports, anchors, expansion loops, and planned pipe movements; and the design of the pipeline heating system, including the integration of applicable technologies as described further herein.

It is also important to recognize that every liquid Sulphur pipeline will almost certainly experience three different flow regimes during its operational life: flowing (i.e., moving, molten) Sulphur (temperature above freezing); stagnant, i.e., liquid Sulphur not flowing, but still in a molten state, (requiring flow to resume); and plugged, in which portions of the pipeline have experienced Sulphur solidification (perhaps with formation of voids) which forms one or more plugs within the pipeline. Each flow regime is generally handled in a respectively different way by pipeline operators with pre-planned appropriate data collected from the pre-commissioning testing activity onwards.

The plugged pipeline flow regime is a critical and troublesome issue for Sulphur pipeline operators when trying to re-establish flow. Because the re-melting of Sulphur in the pipeline can occur at different rates in various portions of the line, it is imperative to perform this re-melt activity in a manner that does not overpressure the pipe or allow other pipeline failure modes to occur. While other factors may be involved, the difficulty of re-establishing flow in a plugged pipeline is generally because the solid-to-liquid phase change of Sulphur creates expansive forces from the volume increase that occurs when solid Sulphur melts and becomes liquid Sulphur. These expansive forces may over-pressurize the pipeline if not accounted for correctly, thereby potentially damaging the pipeline. For example, if sufficient pressure is placed behind a plug of solidified Sulphur in a pipeline, the plug could break loose as a result of the pressure and move, uncontrolled, through the pipeline, potentially damaging the pipeline in the process (e.g., by forcefully coming into contact with sidewalls of the pipeline). By monitoring temperature trends along the pipeline, it is possible to predict and track the movement of freely-moving plugs in the pipeline.

With recent developments in predictive modelling, transient analysis and improved software solutions, it is now possible to create a dynamic, real-time model for detecting and/or predicting solidification of Sulphur (or other process fluids) as it undergoes phase changes inside the pipeline. This modelling may be implemented in an automated re-melt system for a pipeline used to transport process fluid. In particular, one or more cooperating algorithms may be used to determine, based on the latent heat during a Sulphur phase change rather than on commonly defined melting and freezing points of Sulphur, a latent heat signature for either or both phase changes (i.e., from solid to liquid and from liquid to solid). As an example of a latent heat signature associated with a liquid-to-solid phase change of Sulphur, a transient upward temperature spike may be detected at a location along the pipeline at which Sulphur is transitioning from liquid to solid (e.g., freezing). As an example of a latent heat signature associated with a solid-to-liquid phase change of Sulphur, a continuous temperature decrease may be detected at a location along the pipeline at which Sulphur is transitioning form solid to liquid (e.g., melting). The detection of the latent heat signatures described above may be performed by a sensor network coupled to the pipeline and a controller (e.g., central processing unit) in the automated re-melt system may analyze spatio-temporal temperature data (e.g., distributed temperature sensing (DTS) data) produced by the sensor network to determine that a latent heat signature is present in the temperature data and to determine a location of the latent heat signature along the pipeline. Using the latent heat signatures associated with phase changes of a process fluid (in this case Sulphur) to identify solidification or melting of the process fluid at locations along a pipeline is not dependent on a particular melting or freezing temperature. This property of latent heat signature based automated re-melt models may be especially beneficial when used in conjunction with pipelines carrying process material, such as Sulphur, that does not freeze at a discrete temperature, but instead freezes over a temperature gradient (e.g., 114-120° C. in the case of Sulphur).

Predictive modelling used in the automated re-melt system may take into account temperature and elevation factors when predicting where process material is likely to freeze within the pipeline. For example, a section of the pipeline having a low elevation level and having comparatively high elevation adjacent pipeline sections ahead and behind will be likely to accumulate solidified process material due to the geometry of the low elevation section of the pipeline. Considering the case of Sulphur, when Sulphur transitions from a solid to a liquid, the volume of the Sulphur increases. Conversely, when Sulphur transitions from a liquid to a solid, the volume of the Sulphur decreases. When Sulphur in the low elevation section of the pipeline solidifies, the amount of volume taken up by this Sulphur decreases, allowing liquid Sulphur to flow from adjacent sections of pipe into gaps created by this decrease in volume. In this way, it is possible for a section of pipeline to become completely filled (e.g., plugged) with solid Sulphur. When re-melting one of these plugs, there is a risk of over-pressurizing the section of pipeline containing the plug may become over-pressurized due to the expanding volume associated with the solid-to-liquid phase change of Sulphur, which may result in the plug being propelled, uncontrolled, through the pipeline, or may result in a rupture of the pipeline itself.

Heat sinks and other non-uniform heat loss can occur when components such as pipe supports and anchors are designed solely to minimize the pipe movements, without regard to thermal heat loss impact. In addition, poorly installed thermal insulation itself can jeopardize the pipeline heat loss uniformity. For example, thermal insulation may get exposed to moisture as a result of improper insulation. Wet insulation may result in excessive heat loss in the pipeline. The system may identify the location of wet insulation along the pipeline based on the temperature data, and may issue a notification (e.g., to a user through a user interface) indicating that the insulation at the location needs to be repaired or replaced. When heating a pipeline for any service, but particularly so for very high operating temperatures, it becomes imperative to maximize the efficiency of the thermal envelope around the pipeline. This engenders the concept of a "uniform thermal profile", where, ideally, there are no heat sinks along the pipeline that would cause excessive amounts of heat to be lost to surrounding areas. An "intelligent" Sulphur pipeline as provided herein seeks to maintain a uniform thermal profile along the pipeline, even in plugged and re-melt situations.

To achieve a homogenous thermal profile for the entire pipeline, the system integrates existing pipeline heating technology, pre-insulated piping, a sensor network (e.g., a fiber optic based Distributed Temperature Sensing (DTS) system) to monitor pipeline temperature along the entire length of the pipeline, engineered pipe supports and anchors that minimize localized heat loss, and computational modelling and transient analysis. Together, all of these system components and customized procedures create synergies in the operation of Sulphur transport pipelines. These five key components are described further below.

In some embodiments, the heating system may be a skin-effect heat management system. FIG. 1 illustrates an exemplary pipeline temperature management system, including a fiber optic DTS system as described further below. Pipeline temperature management system 100 (e.g., control system) includes a pre-insulated pipe 102, which may be surrounded by composite thermal insulation and cladding 114. Pre-insulated pipe 102 may, for example, may provide higher quality, construction schedule improvements, ease of installation, lower installed cost, durable construction, and reduced maintenance compared to uninsulated pipes. System 100 may further include one or more heat tubes 116 disposed along the length of pre-insulated pipe 102. Heat tubes 116 may act as heaters for pipe 102 and may receive power from power source 126 through transformer 124 and power connection boxes 110. Power may be selectively applied (e.g. using switching circuitry) to heat tubes 116 through power connection boxes 110 based on control signals generated by a controller in control panel 122. Control panel 122 may also include a computer readable non-transitory memory that includes instructions (e.g., computer-executable instructions) that may be executed by the controller in control panel 122 in order to perform operations described herein as being performed by the controller. These control signals may be generated automatically during the regular course of maintaining temperature of pipe 102 around a predetermined setpoint temperature. This setpoint temperature may exceed the nominal melting point of the process fluid by a predetermined amount. When it is determined that process fluid is beginning to solidify in pipe 102 the controller in control panel 122 may instruct heat tubes 116 (e.g., by providing control signals to power connection boxes 110) to provide additional heat (e.g., beyond that which is needed to maintain the temperature of pipe 102 at the setpoint temperature) to sections of pipe 102 in which solidification of process fluid is detected to be occurring. For example, it may be determined that the process fluid is beginning to solidify in pipe 102 by comparing a latent heat signature stored in the memory of control panel 122 to temperature data (for a time period) extracted by the controller in control panel 122 from a sensor system (e.g., DTS system 200 of FIG. 2) and identifying one or more latent heat signatures in the extracted temperature data that match the stored latent heat signature. Additionally, the controller in control panel 122 may instruct heat tubes 116 to apply heat (e.g., additional thermal energy) to pipe 102 according to a re-melt algorithm during full or partial re-melt operations in order to melt solidified process fluid in the pipeline, as described in more detail below.

A fiber optic based DTS system (e.g., which may include one or more fluid temperature sensors) is used to measure temperature across pipe 102. The DTS system includes processing circuitry 120, which may include a frequency generator, a laser source, an optical module, a high frequency mixer, a receiver, and a microprocessor unit. The processing circuitry 120 may be coupled to a fiber optic line 118 disposed along pipe 102, for example, through a fiber optic splice box 112. Optical signals generated at processing circuitry 120 may travel down a length of fiber optic line 118 to a fiber optic end box 104. Reflectometry methods, such as optical frequency domain reflectometry (OFDR) or optical time domain reflectometry (OTDR) may be used to analyze backscatter signals that are created as an optical signal travels along fiber optic line 118. DTS data (e.g., spatio-temporal temperature data for the pipeline) may be generated through the analysis of these backscatter signals, with each data point of the DTS data representing a temperature of the pipeline, the time at which the temperature was measured, and the location along the pipeline at which the temperature was measured. Resistance temperature detectors (RTDs) 108 may optionally be included along pipe 102. RTDs 108 may generate RTD temperature data, separate from the temperature data generated by the DTS system, which may be used for verification of the DTS data (e.g., to ensure that the DTS data is reasonably accurate).

Figure 2:
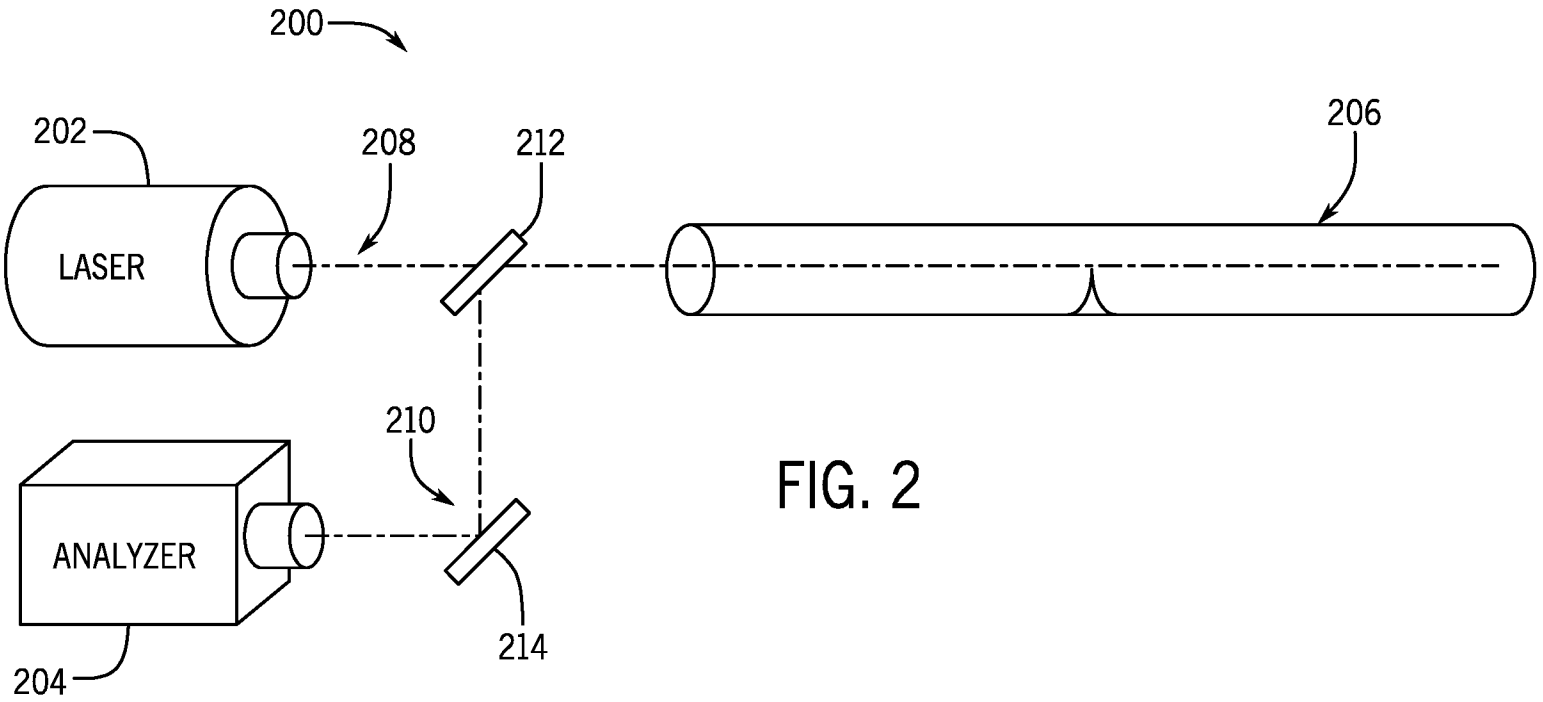
FIG. 2 is a diagram of primary working components for a fiber optic DTS system in accordance with an embodiment.

A more detailed diagram of a DTS system that may be used in connection with system 100 is shown in FIG. 2. DTS system 200 includes a pulsed laser 202 that is coupled to an optical fiber (e.g., fiber optic line) 206 through a directional coupler 212. Pulsed laser 202 may generate laser pulses 208 at a high frequency (e.g., every 10 ns). Light is backscattered as each pulse 208 propagates through the core of fiber 206 owing to changes in density and composition as well as molecular and bulk vibrations. A mirror 214 or any other desired reflective surface may be used to direct the backscattered light 210 to analyser 204. In a homogeneous fiber, the intensity of the sampled backscattered light decays exponentially with distance. The velocity of light propagation in the optical fiber 206 is well defined and modeled, and the distance that pulse 208 travels along fiber 206 before being reflected (e.g., partially) as backscattered light 210 can be calculated by analyser 204 using the deterministic collection time of the backscattered light 210. Thus, a temperature of the pipeline and a distance along the pipeline associated with this temperature can be determined simultaneously from the backscattered light 210.

DTS system 200 is able to measure and analyze backscattered light 210 using interrogation electronics comprised of the laser 202 and the analyser 204 (e.g., a specialized Optical Time Domain Reflectometer) which includes software to analyze specific spectral signals for distributed or point temperature information. Further, DTS system 200 uses fiber 206 as a sensing element to measure temperature utilizing the Raman spectrum of light reflectivity to analyze backscattered light 210 that is created as pulses 208 pass through fiber 206. DTS system 200 may be installed along the full length of a pipeline (e.g., pipe 102 of FIG. 1). DTS system 200 may accurately and timely generate notifications of out-of-range pipeline temperatures. DTS system 200 may provide alarms to indicate to an operator the position and intensity of any extreme temperature event which could jeopardize the flow of process fluid in the pipeline. DTS system 200 may further perform the identification and troubleshooting of heat sinks or cold spots in the pipeline, and may identify locations of these heat sinks or cold spots along the pipeline to within 1 meter accuracy (e.g., by monitoring temperature of the pipeline on a meter-by-meter basis using DTS system 200). Notifications and alarms generated by DTS system 200 may be provided to one or more user devices such as a computer or a mobile device that are connected to the DTS system 200 via a communications system such as the internet, a wide-area-network, or a local-area-network. Analysis of DTS data generated by analyzer 204 may be performed at analyzer 204, or may be performed by an external controller, (e.g., a controller in control panel 122 of FIG. 1) that is communicatively coupled to (e.g., that is in electronic communication with) DTS system 200. Similarly, the notifications and alarms described above as being generated by DTS system 200 may instead be generated and provided to the operator by the external controller.

The DTS system 200 thus provides thermal intelligence by monitoring the temperature along the entire pipeline. DTS or a similar temperature measurement technology may thus be used to generate a temperature profile along the entire pipeline, which may assist in daily decision-making to operate the pipeline efficiently and safely. The DTS system 200 may also accurately record historical process fluid temperatures during routine operations and excursion events. This historical temperature data may be, for example, stored in a non-transitory memory of the DTS system 200. As new temperature data is generated by the DTS system 200, this new temperature data may be verified in order to ensure that the measured temperatures are within a reasonable range based on predefined ranges that may be stored in the non-transitory memory of DTS system 200. This verification may be performed on the new temperature data before the new temperature data undergoes further analysis at analyser 204 as described above and before the new temperature data is stored as part of the historical temperature data in the non-transitory memory of the DTS system 200. If the new temperature data is successfully verified, the analysis and storage continues normally. Otherwise, if the new temperature data does not pass verification (e.g., the new temperature data is outside of the predefined ranges), the new temperature data is discarded and does not undergo further processing or storage.

With the introduction of the present automated system and programming, the re-melt process for a pipeline may become more predictable, with less left to chance. Automated re-melt may be performed based on DTS data for the pipeline and other dynamic information gathered for the pipeline. Returning to FIG. 1, the pipeline management system 100 may further include one or more of each of several different types of sensor inputs for generating pipeline data and other dynamic information (e.g., which may be sent to and received by the controller of control panel 122 of FIG. 1). These inputs may include both distributed and discrete measurements, and may generate data describing the process fluid and its flow, as well as the status of different system components such as the heating system, insulation, sensors, and the pipe sections themselves.

This data processing extends beyond traditional pipeline temperature monitoring, which is generally limited to providing pre-alarms or alarms when the pipeline temperature has moved out of the acceptable range for some portion of the pipeline. Instead, the present system 100 provides data analysis (or logic) modules that are used in the support of the day-to-day operation and maintenance of the pipeline. In some embodiments, these logic modules can be divided into three categories according to their functionality: Operations, which can include modules for monitoring and reporting on process flow characteristics and detecting plugs, temperature changes, and other anomalies; Maintenance, which can include modules for monitoring pipeline components such as the heater system, insulation, sensors, anchors, and the like; and "Special Case" modules for performing particular tasks such as specific pre-commissioning and commissioning tests and re-melt process management. The logic modules may be implemented as processes running on a controller in system 100, (e.g., the controller in the control panel 122).

The development of customized algorithms created from data measured during testing (pre-commissioning), commissioning, and pipeline start-up can be applied to create a pipeline behavior predictive model, which may be implemented in a specialized software framework. These algorithms should be deterministic, with intrinsic latencies associated collecting pipeline data from the system 100 accounted for as part of the algorithms. Uncertainty may be associated with the collection of some portions of the pipeline data, which may be accounted for by implementing latency windows in the algorithms. When dealing with unknown data latency, processing performed by system 100 (e.g., by a controller in system 100) may be delayed until a predetermined amount of pipeline data has been received. All pipeline data should be appropriately temporally and spatially sequenced in order to preserve the integrity of data processing and analysis performed by system 100.

Predictive modelling of system 100 may take into account temperature and elevation factors when predicting where process material is likely to freeze within the pipeline. For example, a section of the pipeline having a low elevation level and having comparatively high elevation adjacent pipeline sections ahead and behind will be likely to accumulate solidified process material due to the geometry of the low elevation section of the pipeline. Meter-by-meter elevation data for the pipeline may be stored in a non-transitory memory of system 100, and may be used to identify these areas of low elevation. Considering the case of Sulphur, when Sulphur transitions from a solid to a liquid, the volume of the Sulphur increases. Conversely, when Sulphur transitions from a liquid to a solid, the volume of the Sulphur decreases. When Sulphur in the low elevation section of the pipeline solidifies, the amount of volume taken up by this Sulphur decreases, allowing liquid Sulphur to flow from adjacent sections of pipe into gaps created by this decrease in volume. In this way, it is possible for a section of pipeline to become completely filled (e.g., plugged) with solidified Sulphur. When re-melting one of these plugs, there is a risk of over-pressurizing the section of pipeline containing the plug may become over-pressurized due to the expanding volume associated with the solid-to-liquid phase change of Sulphur, which may result in the plug being propelled, uncontrolled, through the pipeline, or may result in a rupture of the pipeline itself. By using predictive modeling to accurately anticipate the formation of solidified process fluid in these low elevation regions (or other regions in which Sulphur solidification is determined to be likely), system 100 may proactively apply heat to these regions to prevent plugging.

It should be noted that, while the above example describes elevation-based predictive modeling, other pipeline regions and conditions may be identified as being susceptible to solidified process fluid accumulation and plugging. For example, curves in the pipeline may tend to accumulate more solidified process fluid compared to straight sections of the pipeline, and anchor points along the pipeline may accumulate more solidified process fluid as a result of heat transfer to the anchors supporting the pipeline, which may drop the temperature of the anchor points below the freezing point of the process fluid.

By predictively modelling the pipeline in this way, pipeline temperature and pump speed may be dynamically managed by system 100 to balance freeze risk and operating/maintenance costs based on ambient temperature, input product temperature and other factors.

Referring to FIG. 3, information generated by the Operations, Maintenance, and Special Case algorithm modules summarized above can be organized and presented at a pipeline management console using a custom "Smart Dashboard" user interface 300. The pipeline management console may be implemented on an electronic device (e.g., a client device), such as a computer or a mobile device, that is communicatively connected to pipeline management system 100 of FIG. 1 through a communications network (e.g., a local network or through the internet).

User interface 300 allows control room personnel (e.g., operators) to immediately identify the current state of the pipeline and to initiate appropriate responses or actions recommended by the software. Using navigation tools, users can toggle between a wide range of advanced data summary and analysis screens. The software (e.g., software running on the controller in the control panel 122 of FIG. 1) sends automated messages to one or more of these client systems (e.g., via email or through a short message service (SMS)), as required, to notify personnel of conditions on the pipeline that require attention or intervention. FIG. 3 illustrates a sample screen of the pipeline management console's user interface 300, in accordance with the present disclosure. The screen demonstrates that many key operational parameters can be shown at once on a single Smart Dashboard. The user interface 300 may be displayed on the screen of the client system. For example, the pipeline management console of which user interface 300 is a part may be accessible by logging into a web portal with a user ID and (optionally) a password unique to an individual operator or group of operators. The pipeline management console may enable different individual functions for different operators or groups of operators based on the user ID used to access the console through the web portal.

Figure 4:
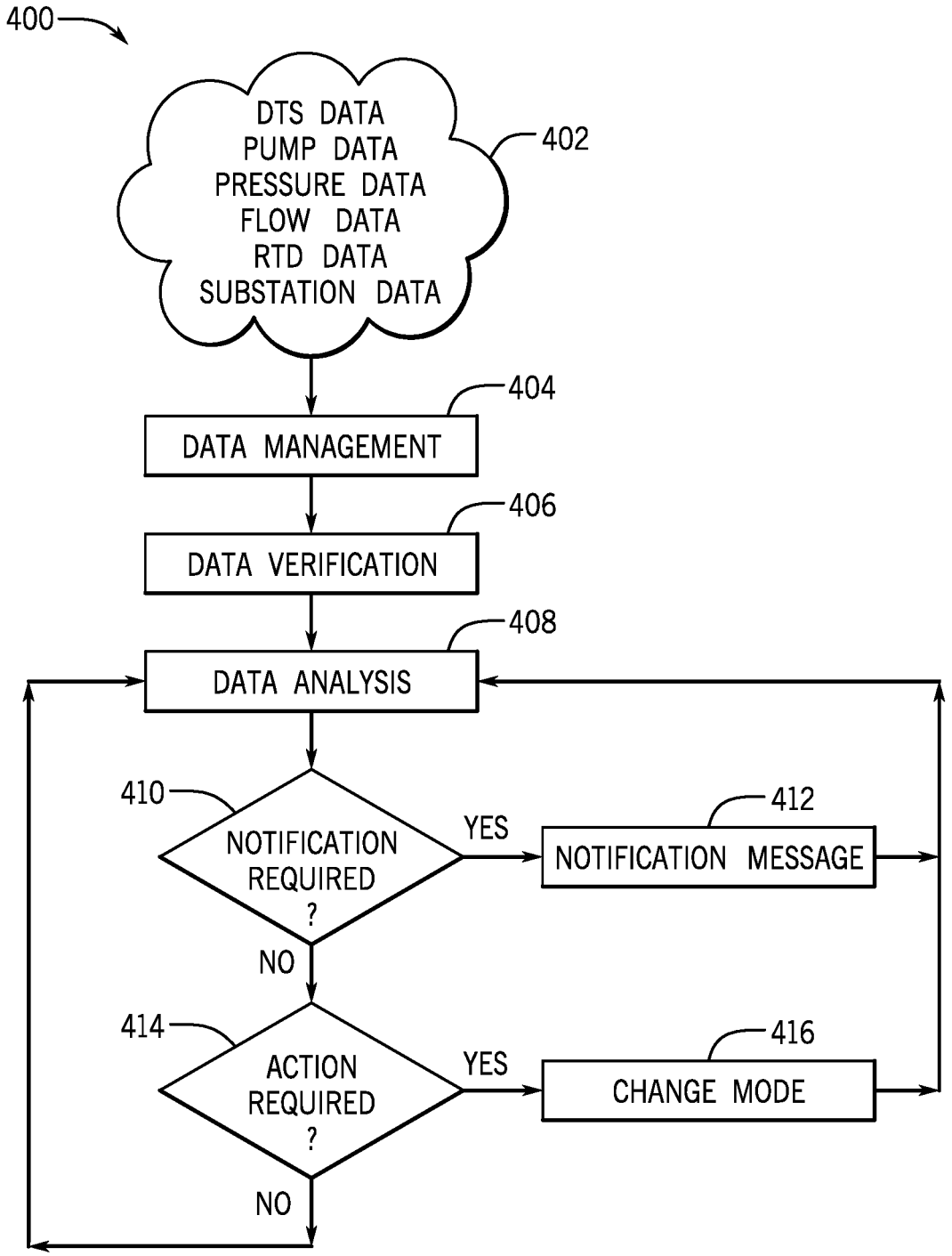
FIG. 4 is a decision logic flowchart for managing a pipeline in accordance with an embodiment.

The basic operation of system 100 of FIG. 1 may follow a process 400 of the logic diagram shown in FIG. 4. At 402, pipeline data may be collected from sensors and other system components such as the DTS system 200 of FIG. 2 and may be aggregated. At 404, the pipeline data may be managed by the system 100 at 404. At 406, prior to any data analysis, the pipeline data may be verified (e.g., by the controller in control panel 122 or by analyser 204) as properly sourced and complete using any suitable verification process. For example, temperature measurements in the DTS data may be compared to predefined temperature ranges stored in memory in order to verify that these temperature measurements are reasonable, which may reduce noise and may ensure accuracy of the system 100. At 408, a controller within system 100 (e.g., the controller in control panel 122 or analyser 204) can analyze the data to determine, at 410, whether any notification to an operator is required, and to further determine, at 414, whether any action should be taken by an operator or by the system 100 itself. If no notification or action is required, process 400 returns to 408 to analyze any new incoming pipeline data. If notification is determined to be required, at 412 a notification message may be provided to an operator (e.g., via email or SMS) and process 400 then returns to 408. If action is determined to be required, at 416 a message may be provided to an operator (e.g., via email or SMS) requesting that the required action be taken, or system 100 may take the required action automatically, without user intervention, and process 400 then returns to 408. Required actions may, for example, include initiating (e.g., with a controller in system 100) partial or full re-melt procedures in response to detecting solidified process fluid in the pipeline.

The automated re-melt manager, which may be a "Special Case" module as described above, can be engaged when the Operations Module algorithms (e.g., hardcoded algorithms) detect and respond to a plug or frozen section in the pipeline. Solidified process fluid in the pipeline can be detected by one of two techniques: detection of a plug in the pipeline that is preventing flow despite the fact that the pump is operating; or, detection that process fluid in a section of the pipeline has undergone a phase transition to the solid state (e.g., based on the latent heat signature associated with the solidification of the process fluid).

Figure 5:
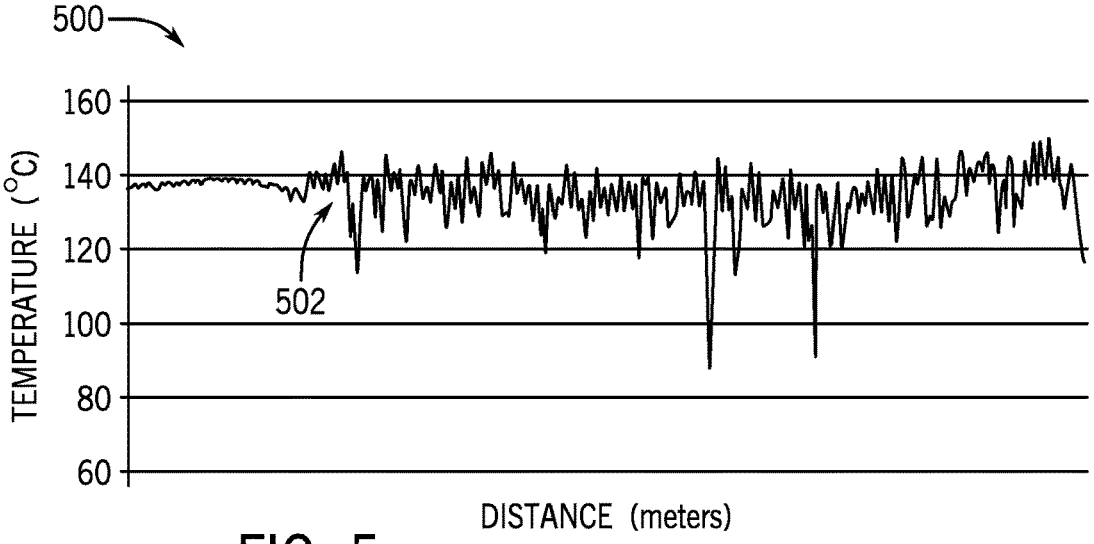
FIG. 5 is a diagram of a temperature profile plot (of temperature by distance) along a pipeline, measured with fiber optic DTS.

FIG. 5 shows the temperature profile measured when a localized solidified Sulphur plug prevented the pipeline from being filled. To generate the illustrated plot 500, the empty pipeline was pre-heated, filled for the first time, and then drained. Shortly after liquid Sulphur was re-introduced to the pipeline, flowmeter data showed that the flow had stopped at location 502, despite the fact that the pump was running and pump outlet pressure was normal.

The spatial variance of the temperature data of the section of pipe containing liquid Sulphur (the left side of the diagram) is very low with little noise. This is in sharp contrast to the relatively higher variance seen in data for the empty section of the pipe (the right side of the diagram). This combination of inputs (pump running, pressure normal, flow stopped, DTS temperature variance showing bimodal behavior) allows the logic modules to determine the presence (e.g., occurrence) and precise location of the plug. In this case, the system 100 assesses the distribution of the solid Sulphur phase in the pipeline, as the type and extent of the re-melt process to be utilized depends on the extent to which the Sulphur has frozen.

Figure 6:
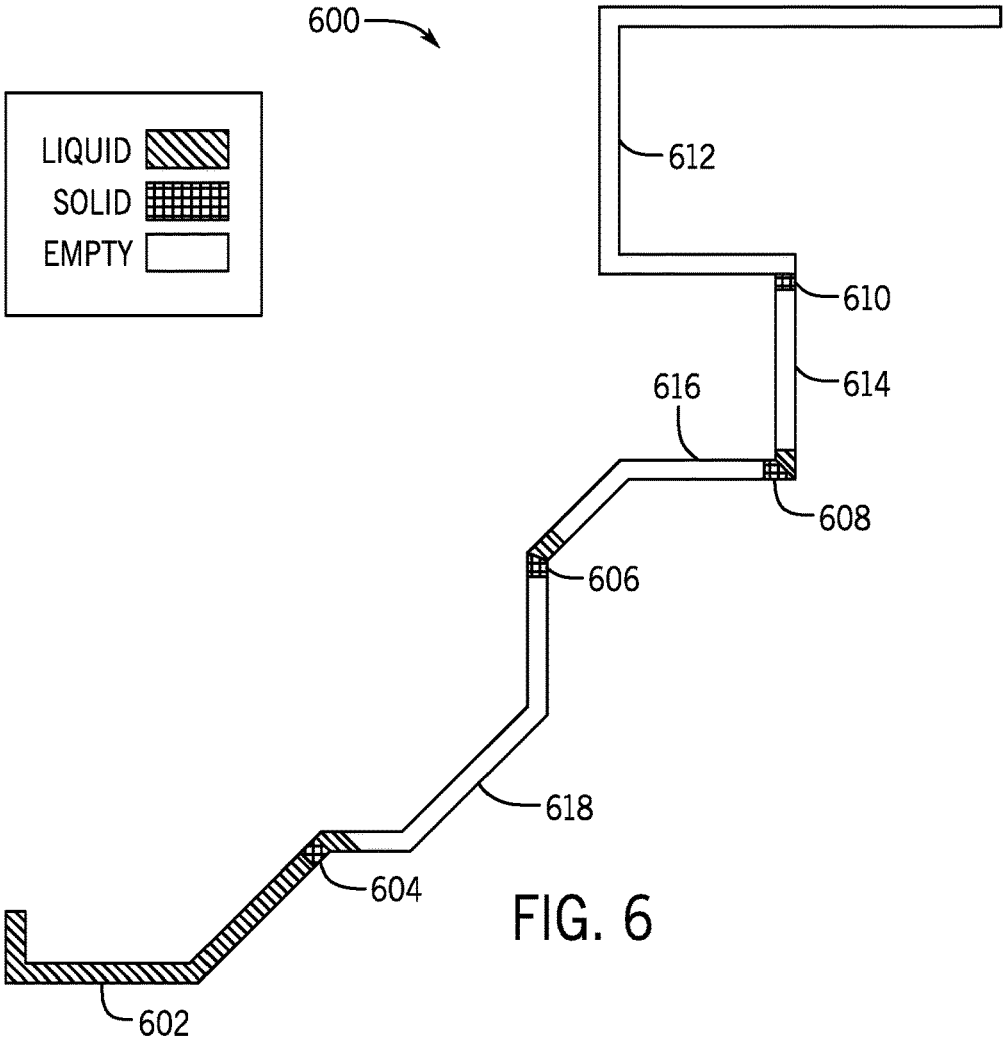
FIG. 6 is a schematic diagram display of process fluid flow (phase and pipeline fill) in a pipeline, in accordance with an embodiment.

FIG. 6 shows the schematic diagram generated when the pipeline management system 100 combines historical data for key parameters with the pipeline's analytical model to conduct an assessment of the solidified and liquid Sulphur present in the pipeline. This schematic may be displayed to an operator for use in analyzing a present state of system 100 (e.g., and may be accessible through user interface 300 of FIG. 3) While the present schematic is related to Sulphur, it should be noted that the schematic and corresponding processes may be used in conjunction with any other desired process fluid.

In the schematic, liquid Sulphur is shown with diagonal hatch marks, solidified Sulphur is shown with a vertical and horizontal crosshatch, and empty pipe is displayed with no pattern. The pipeline 600 has experienced localized plugging in four places, 604, 606, 608, and 610. Some liquid Sulphur is present immediately downstream from plugs 604, 606, and 608, and liquid Sulphur fills section 602 of the pipeline, before the first plug 604. Sections 612, 614, 616, and 618 may be substantially empty (devoid of liquid or solidified Sulphur) as a result of the plugs or as a result of intentional draining of the liquid Sulphur in these regions. The pipeline may be conceptually divided into multiple heating zones, and the heating cables in each of these heater zones may be independently controllable. When the solidified Sulphur is localized within a few meter span of pipeline (as in the above example), it can be re-melted by use of a partial re-melt routine which temporarily maximizes heater power (and, thereby, corresponding heat output) in the affected area. In this case, the system 100 can activate the heating zone which contains the frozen Sulphur and identify the exact location of the plug so that the plug site can be visually inspected and externally heated if necessary. All unaffected heating zones will be set to cycle normally at their stagnant line set point temperature. The system 100 can return the activated heating zone to normal operation once thermal evidence (e.g., DTS data) has been collected by the system 100 verifying that the plug re-melt has been fully completed.

Figure 7:
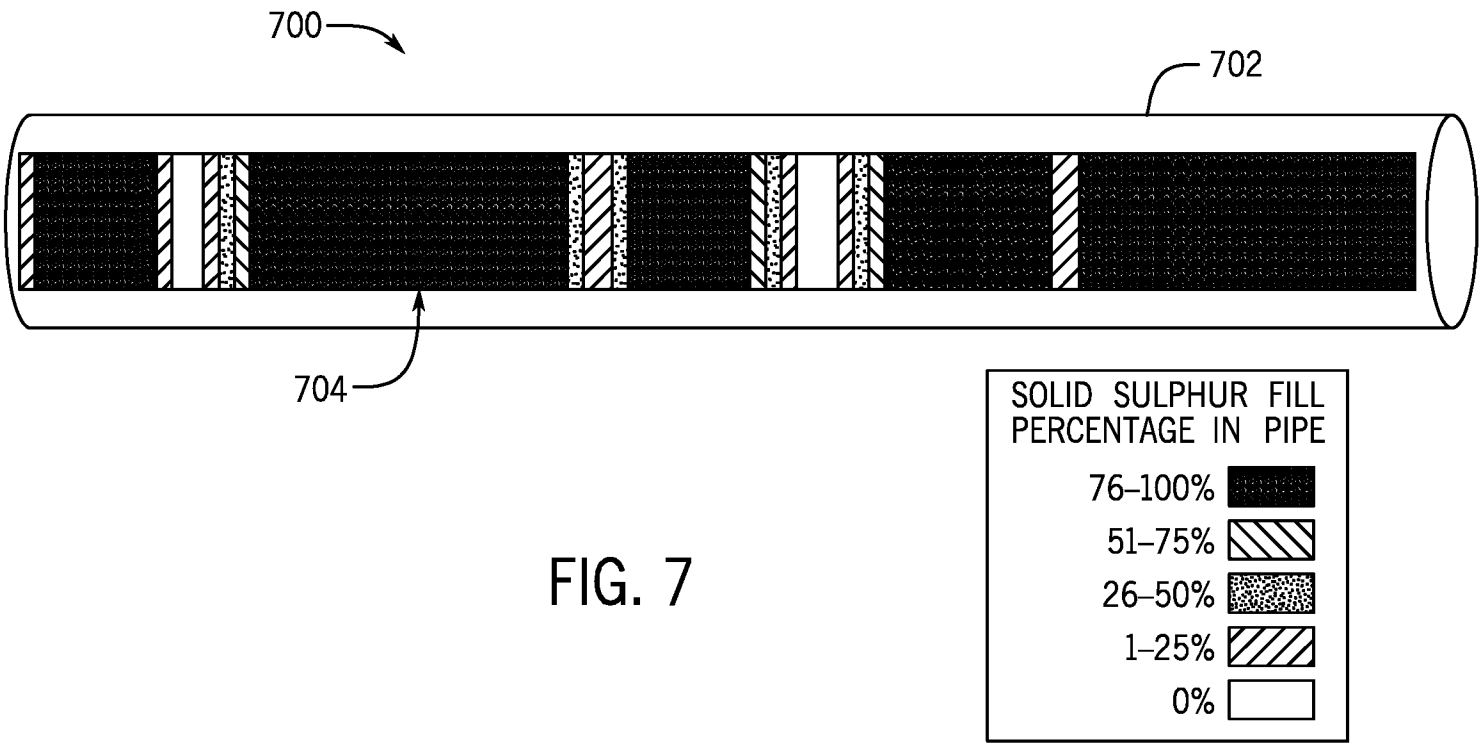
FIG. 7 is a diagram of another display of process fluid flow (pipeline fill percentage) in a pipeline, in accordance with an embodiment.

When the algorithms detect that Sulphur has solidified over longer sections of the pipeline (e.g., greater than a predetermined length), the system 100 can shift into full re-melt mode. This process begins with a notification to the operations staff recommending certain actions. For example, the pipeline management console can inform operations staff as to where vents and drains align with pockets of liquid Sulphur that may be drained to simplify the re-melt. Following these actions, the operations staff may acknowledge the prompt provided by pipeline management system 100 recommending actions and the heating system will commence with the automatic re-melt. After the section of pipe to be re-melted drops below the Sulphur's freezing point, the pipeline drainage and cool-down logic module can generate solidified Sulphur fill distribution data by monitoring the cool-down rate or heating rate (e.g., by monitoring the rate of change over time of temperatures) at different locations along the pipeline. The cool-down rate or heating rate may change depending on the amount of solid or liquid Sulphur (or both solid and liquid Sulphur) that is present at a given location along the pipeline. This location and fill percentage data (both solidified and liquid fill percentage) for the Sulphur can provide the baseline for monitoring the re-melt activity. FIG. 7 illustrates an example case, where an entire transit pipeline has been cooled below the Sulphur freezing point with minimal drainage prior to the phase change. In diagram 700, the pipe 702 is almost completely filled with solidified Sulphur. This graphical representation of pipeline fill distribution 704 may be presented to an operator through a graphical user interface of a client system (e.g., accessible through user interface 300 of FIG. 3) communicatively connected to the pipeline management system 100.

The pipeline and drainage cool down model resolves the solidified Sulphur pipeline fill percentage into four categories: 0% filled (no pattern) 1%-25% filled (upper right diagonal hatch mark pattern); 26%-50% filled (crosshatch pattern); 51%-75% filled (lower right diagonal hatch mark pattern); and 76%-100% filled (solid fill pattern). The fill distribution information is utilized during the re-melt to predict where empty pipe volume is available to accommodate the Sulphur expansion during its phase change. To begin the re-melt, the system 100 utilizes the various heater zones and available power levels to achieve a uniform pipeline temperature that is just below the Sulphur melting point. If this is not achievable, the system 100 will revert to a temperature maintenance mode at which the heater zones maintain the pipeline temperature at a predefined setpoint temperature and notify operations and maintenance staff of the existing non-uniformity issues. Any such issues should be resolved prior to the automated re-melt being allowed to progress.

Once a uniform pre-melt temperature profile has been achieved, the pipeline management system 100 can provide an operator with prompt (e.g., at a client system used by the operator) to verify that all pipeline valves, vents, and drains are set to the open position. This will provide the maximum available expansion volume to accommodate the Sulphur phase change from solid to liquid during re-melt. For example, the system 100 may begin to increase the temperature of the pipeline toward the Sulphur melting point only after this prompt has been acknowledged by the operations staff. As the temperature of the pipeline increases, the Sulphur melt algorithm can track the progress (e.g., on a meter-by-meter basis) of the Sulphur phase change from solid to liquid. This phase change data (e.g., pipeline re-melt data) is analyzed (e.g., by the controller in control panel 122 of FIG. 1) for uniformity at the critical pipeline sections (with sections with low available expansion volume), as identified by the drainage and cool down algorithm. The pipeline management system 100 controls the heater zones and power levels available to synchronize the phase change along these key pipeline sections.

The proposed algorithms may, in some embodiments, be used during initial deployment and testing of the pipeline heating and control systems to determine the latent heat signature unique to the process material and generated as the process material undergoes its phase changes within the pipeline, and at different points along the pipeline. Then, rather than make use of the melting and freezing points of Sulphur (which may be ambiguous and may lack definition) to manage the re-melt, the system 100 may use the latent heat signature for either phase change (solid-to-liquid or liquid-to-solid) as measured by the DTS system. For example, during the freezing of the liquid Sulphur in the pipeline, the DTS data may show (on a meter-by-meter basis) the heat that is released when the liquid Sulphur freezes (i.e., solidifies). This allows the system 100 to detect the change from liquid to solid Sulphur on a distributed basis along the entire length of the pipeline. Similarly, during the melting of solidified Sulphur in the pipeline, the DTS data shows (on a meter-by-meter basis) the drop in the temperature increase, per fixed unit heat input, that occurs when the solidified Sulphur melts. Analysis of the DTS data allows the system 100 to detect the change from solid to liquid Sulphur on a distributed basis along the entire length of the pipeline. Thus, the system 100 interprets the latent heat signature of the actual phase transition, independent of the Sulphur's measured temperature, from the DTS data in order to identify Sulphur phase transitions as they occur in the pipeline. This identification may be performed at resolutions of one meter or even less—that is, the system 100 may receive DTS data from sensors at every meter of the pipeline, in some embodiments, and may identify potential Sulphur solidification with approximately one meter of accuracy. It should be noted that, while processing tasks described herein have been directed to the processing of DTS data, this is meant to be illustrative and not limiting. Any other desired data type, such as supervisory control and data acquisition (SCADA), may be used in place of, or in conjunction with, DTS data.

If at any point in the automated re-melt process the algorithms are unable to achieve a spatially uniform phase change, the system 100 will hold the pipeline temperature below the melting point of the Sulphur and notify operations and maintenance personnel of the pipeline locations (by specific meter marks) where the required uniformity cannot be achieved. For example, the algorithms (e.g., being executed on the controller in control panel 122) may determine that the heating rate (e.g., rate of change of temperature) at some locations along the pipeline indicates that solidified process fluid is changing phases from solid to liquid at a given rate at those locations, while the heating rate at other locations along the pipeline indicates that solidified process fluid is changing phases from solid to liquid at a rate that is different from the given rate at those other locations. This determination may be indicative of a spatially non-uniform phase change taking place within the pipeline, which may require intervention on the part of operations and maintenance personnel (e.g., operators), as described above. Only after control room personnel have verified that the uniformity problems identified by the system 100 have been resolved, will the system 100 re-start the automated re-melt process engine. When the system 100 has verified that the re-melt is complete, operations personnel will be instructed to close the pipeline's vents and drains. The heater set point temperature will be increased to the stagnant liquid Sulphur target value. Once the pipeline heaters are cycling normally at the stagnant liquid Sulphur setpoint, the pumps can be started and the control software placed back into its normal operating and maintenance mode.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. Various features and advantages of the invention are set forth in the following claims.

What is claimed is:

1. A control system for use with a pipeline that transports a process fluid and a heating system that applies thermal energy to the pipeline, the control system comprising:

a sensor network configured to record pipeline data, the sensor network comprising a plurality of temperature sensors at a plurality of locations along the pipeline; and a controller in electronic communication with the sensor network, the controller comprising a processor and memory storing specific computer-executable instructions that, when executed by the processor, cause the controller to:

receive the pipeline data from the sensor network;

determine, based on the pipeline data, a plurality of rates of change of a plurality of temperatures at the plurality of locations along the pipeline over time;

determine, based on one or more of the plurality of rates of change, that a plug of solidified process fluid is in the pipeline at a first location; and cause, via electronic communication with a client system, a graphical user interface of a client system to display a representation of the plug at the first location.

2. The control system of claim 1, wherein the sensor network comprises a fiber optic based distributed temperature sensing (DTS) system.

3. The control system of claim 2, wherein execution of the instructions by the processor further causes the controller to:

generate, based on the pipeline data, a distribution of solidified process fluid along a section of the pipeline that includes the first location of the plug; and cause, via communication with a client system, the distribution to be displayed via a graphical user interface of the client system.

4. The control system of claim 3, wherein the controller, to generate the distribution of the solidified process fluid, calculates a plurality of fill percentages representing, respectively, an amount of process fluid that is present at each location of a subset of the plurality of locations included in the section of the pipeline.

5. The control system of claim 4, wherein execution of the instructions by the processor further causes the controller to:

control the heating system to uniformly heat the section of the pipeline to a pre-melt temperature that is a predetermined number of degrees below a melting point of the solidified process fluid; and cause the heating system to initiate a re-melt process in which the heating system increases the temperature of the section of the pipeline to at least the melting point of the solidified process fluid.

6. The control system of claim 5, wherein execution of the instructions by the processor further causes the controller to:

receive, from the sensor network, a subset of the pipeline data during the re-melt process;

determine, based on the subset of the pipeline data, that at least a portion of the solidified process fluid in the section of the pipeline has undergone a spatially non-uniform phase change; and cause the heating system to stop the re-melt process and to return the temperature of the section of the pipeline to near a melting point of the solidified process fluid.

7. A method for thermal management of a pipeline, comprising:

recording pipeline data corresponding to temperature characteristics of the pipeline;

determining a plurality of pipeline temperature rates of change corresponding to a plurality of locations along the pipeline over time;

determining based on a first pipeline temperature rate of change of the plurality of pipeline temperature rates of change, that a plug of solidified process fluid is in the pipeline at a first location; and displaying a representation of the plug at the first location.

8. The method of claim 7, wherein the pipeline data is recorded by a sensor network that comprises a fiber optic based distributed temperature sensing (DTS) system.

9. The method of claim 7, further comprising:

instructing a heating system to apply power to heaters in a first heating zone of the pipeline corresponding to the first location; and instructing the heating system to maintain a second heating zone of the pipeline at a stagnant line set point temperature.

10. The method of claim 9, further comprising:

generating, based on the pipeline data, a distribution of solidified process fluid along a section of the pipeline that includes the first location; and displaying a graphical representation of the distribution of the solidified process fluid along the section of the pipeline.

11. The method of claim 10, further comprising:

determining, based on the pipeline data, that a length of the plug is greater than a predetermined length;

instructing the heating system to uniformly heat the section of the pipeline to a pre-melt temperature that is a predetermined number of degrees below a melting point of the solidified process fluid; and instructing the heating system to initiate a re-melt process in which the heating system increases the temperature of the section of the pipeline to at least the melting point of the solidified process fluid.

12. The method of claim 11, further comprising:

determining, during the re-melt process, that the solidified process fluid in the section of the pipeline is undergoing a spatially non-uniform phase change based on a latent heat signature in the pipeline data corresponding to a drop in heating rate that occurs when the solidified process fluid undergoes a solid-to-liquid phase change.

13. The method of claim 12, further comprising:

instructing, during the re-melt process in response to determining that the solidified process fluid in the section of the pipeline is undergoing the spatially non-uniform phase change, the heating system to stop the re-melt process and to maintain the temperature of the section of the pipeline near the melting point of the solidified process fluid.

14. The method of claim 10, wherein generating the distribution of the solidified process fluid along the section of the pipeline comprises:

calculating a fill percentage representing an amount by which the first location of the pipeline is filled with solidified process fluid.

15. The method of claim 14, wherein calculating the fill percentage representing the amount by which the first location of the pipeline is filled with solidified process fluid comprises:

calculating the fill percentage representing the amount by which the first location of the pipeline is filled with solidified process fluid based on the first pipeline temperature rate of change.

16. A system for use with a pipeline that transports a process fluid and a heating system that applies thermal energy to the pipeline, the system comprising:

a sensor network configured to record temperature data for a pipeline, the temperature data including temperature measurements for each of a plurality of locations along the pipeline over time; and a controller in electronic communication with the sensor network, the controller comprising a processor and memory storing computer-executable instructions that, when executed by the processor, cause the controller to:

receive the temperature data from the sensor network;

determine, based on the temperature data, a rate of change of temperature of a first location of the plurality of locations of the pipeline;

determine, based on the rate of change of temperature, that solidified process fluid is present in the pipeline at the first location;

determine, based on the temperature data, a fill percentage representing an amount of solidified process fluid estimated to be present at the first location; and electronically communicate with a client system to cause a graphical user interface of the client system to display a graphical representation of the fill percentage at the first location of the pipeline.

17. The system of claim 16, wherein the sensor network comprises a fiber optic based distributed temperature sensing (DTS) system.

18. The system of claim 17, wherein the graphical representation further includes a pipeline fill distribution along the pipeline, wherein the pipeline fill distribution comprises the fill percentage for the first location and a plurality of additional fill percentages for additional locations of the plurality of locations of the pipeline.

19. The system of claim 18, wherein the computer-executable instructions, when executed by the processor, further cause the controller to:

determine, based on a latent heat signature in the temperature data, that the solidified process fluid at the first location corresponds to a plug.

20. The system of claim 19, further comprising:

a heating system configured to apply thermal energy to the pipeline, wherein the computer-executable instructions, when executed by the processor, cause the controller to:

provide a prompt to the client system requesting that additional power be applied to one or more heaters of the heating system near the first location of the plug in the pipeline.

* * * * *